US008556674B2

(12) United States Patent
Curry

(10) Patent No.: US 8,556,674 B2
(45) **Date of Patent: *Oct. 15, 2013**

(54) SELF-PRIMING UNDERWATER DEVICE FOR GENERATING OR SHOOTING A VORTEX RING

(75) Inventor: Eric W Curry, El Segundo, CA (US)

(73) Assignee: Tecmap Corporation, El Segundo, CA (US)

( * ) Notice: Subject to any disclaimer, the term of this patent is extended or adjusted under 35 U.S.C. 154(b) by 330 days.

This patent is subject to a terminal disclaimer.

(21) Appl. No.: 13/067,017

(22) Filed: May 3, 2011

(65) Prior Publication Data

US 2012/0052965 A1 Mar. 1, 2012

Related U.S. Application Data

(63) Continuation-in-part of application No. 12/929,439, filed on Jan. 25, 2011, now Pat. No. 8,465,375, and a continuation-in-part of application No. 29/371,380, filed on Jan. 25, 2011, now abandoned.

(60) Provisional application No. 61/376,867, filed on Aug. 25, 2010, provisional application No. 61/457,328, filed on Mar. 1, 2011.

(51) Int. Cl.
*A63H 23/00* (2006.01)

(52) U.S. Cl.
USPC ..... 446/153

(58) Field of Classification Search
USPC ..... 472/128
See application file for complete search history.

(56) References Cited

U.S. PATENT DOCUMENTS

| | | | | |
|---|---|---|---|---|
| 3,288,064 | A * | 11/1966 | Gongwer | 102/322 |
| 3,372,873 | A | 3/1968 | Weiss et al. | |
| 3,589,603 | A * | 6/1971 | Fohl | 239/11 |
| 3,940,060 | A | 2/1976 | Viets | |
| 4,534,914 | A * | 8/1985 | Takahashi et al. | 261/64.3 |
| 5,042,819 | A | 8/1991 | LaFata | |
| 5,052,813 | A | 10/1991 | Latto | |
| 5,100,242 | A * | 3/1992 | Latto | 366/267 |
| D331,609 | S | 12/1992 | LaFata | |
| 5,865,438 | A | 2/1999 | Zilliox | |
| 5,947,784 | A * | 9/1999 | Cullen | 446/15 |
| 6,007,237 | A | 12/1999 | Latto | |
| D427,600 | S | 7/2000 | Pröbstel et al. | |

(Continued)

OTHER PUBLICATIONS

Office Action dated Dec. 6, 2012, in co-pending utility U.S. Appl. No. 12/929,439, filed Jan. 25, 2011.

(Continued)

*Primary Examiner* — Kurt Fernstrom
*Assistant Examiner* — Dolores Collins
(74) *Attorney, Agent, or Firm* — Dinesh Agarwal, P.C.

(57) ABSTRACT

A self-priming underwater device for generating a vortex ring entrained with a fluid, includes a handle, a housing including front and rear sections, a trigger for supplying a fluid to the housing, a piston assembly in the rear section of the housing and including a yoke, a piston movable in the yoke, and a plate for displacing a liquid, and a splitter for diverting one portion of the fluid to the piston assembly to thereby move the piston. The front section of the housing includes an opening for discharging a vortex ring therefrom, and a fluid supply member is positioned adjacent the opening for supplying another portion of the fluid to be entrained in the vortex ring.

22 Claims, 10 Drawing Sheets

(56) References Cited

U.S. PATENT DOCUMENTS

| | | | | |
|---|---|---|---|---|
| 6,488,270 | B2 * | 12/2002 | Whiteis | 261/62 |
| 6,736,375 | B2 * | 5/2004 | Whiteis | 261/64.1 |
| 6,824,125 | B2 * | 11/2004 | Thomas | 261/64.3 |
| 6,953,376 | B1 | 10/2005 | Kim et al. | |
| D521,574 | S | 5/2006 | McBride et al. | |
| 7,059,544 | B2 | 6/2006 | Leonard et al. | |
| 7,191,774 | B2 | 3/2007 | Thorne | |
| D548,290 | S | 8/2007 | Chuang et al. | |
| 7,300,040 | B2 * | 11/2007 | Thomas | 261/79.2 |
| 7,673,834 | B2 | 3/2010 | Harman | |
| 7,731,064 | B2 | 6/2010 | Chuang et al. | |
| 2004/0088894 | A1 | 5/2004 | Haughton et al. | |
| 2004/0217490 | A1 | 11/2004 | Whiteis | |
| 2006/0214316 | A1 | 9/2006 | Whiteis | |
| 2007/0200260 | A1 | 8/2007 | Whiteis | |
| 2010/0015879 | A1 | 1/2010 | Davis | |
| 2010/0184523 | A1 | 7/2010 | Davis | |
| 2012/0052965 | A1 * | 3/2012 | Curry | 472/128 |

OTHER PUBLICATIONS

Office Action dated Nov. 2, 2012, in co-pending utility U.S. Appl. No. 12/929,439, filed Jan. 25, 2011.

U.S. Appl. No. 12/929,439, filed Jan. 25, 2011, entitled "Underwater Device for Generating or Shooting a Vortex Ring".

U.S. Appl. No. 29/371,380, filed Jan. 25, 2011, entitled "Underwater Vortex Ring Shooter".

Office Action dated Aug. 14, 2012, in co-pending design U.S. Appl. No. 29/371,380, filed Jan. 25, 2011.

* cited by examiner

SELF-PRIMING UNDERWATER DEVICE FOR GENERATING OR SHOOTING A VORTEX RING

CROSS-REFERENCE TO RELATED APPLICATIONS

This is a continuation-in-part (CIP) application of U.S. application Ser. No. 12/929,439, filed Jan. 25, 2011, and Ser. No. 29/371,380, filed Jan. 25, 2011, both of which are hereby incorporated herein in their entirety by reference. This application further claims the priority benefit of U.S. Provisional Patent Applications Ser. No. 61/376,867, filed Aug. 25, 2010, and Ser. No. 61/457,328, filed Mar. 1, 2011, both of which are also hereby incorporated herein in their entirety by reference.

FIELD AND BACKGROUND OF THE INVENTION

The present invention is generally directed to a toy or amusement device, and more particularly to an underwater device for generating or shooting a vortex ring.

It is entertaining to generate or watch a bubble ring being generated, whether in air or in a liquid medium, such as water. Both the children and adults are known to engage in such an activity. For instance, children learn to make soap bubbles at an early age. Likewise, the adults are often seen to amuse others and themselves by generating smoke rings when smoking a cigarette, pipe, or cigar. Watching the rings or bubbles rise up in the air or through a liquid, is not only uplifting, but also aesthetically very pleasing.

Various devices for generating bubbles and rings are available in the prior art, as shown in U.S. Patents/Publications Nos. 3,372,873; 3,589,603; 4,534,914; 5,042,819; 5,052,813; 5,100,242; 5,947,784; 6,007,237; 6,488,270; 6,736,375; 6,824,125; 7,191,774; 7,300,040; 2004/0088894; 2004/0217490; 2006/0214316; 2007/0200260; 2010/0015879; and 2010/0184523.

ASPECTS OF THE INVENTION

The present disclosure is directed to various aspects of the present invention.

One aspect of the present invention includes an underwater device for generating or shooting a vortex ring.

Another aspect of the present invention includes an underwater device for generating or shooting a vortex ring of a liquid, such as water, and a fluid, such as air. In particular, the device generates a vortex ring that is entrained with air.

Another aspect of the present invention includes an underwater device for generating or shooting a vortex ring that is hand-held.

Another aspect of the present invention includes an underwater device for generating or shooting a vortex ring that is manually-powered.

Another aspect of the present invention includes an underwater device for generating or shooting a vortex ring that is self-contained in that it includes a supply of unpressurized fluid or air.

Another aspect of the present invention includes an underwater device for generating or shooting a vortex ring that has a volume capacity to produce multiple consecutive vortex rings before reloading. In particular, the device is configured to fire repeatedly to produce five to fifty vortex rings with one full chamber of air.

Another aspect of the present invention includes an underwater device for generating or shooting a vortex ring, wherein the air for rings is ejected by the same force of water being ejected substantially simultaneously.

Another aspect of the present invention includes an underwater device for generating or shooting a vortex ring that is simple in design and whose function is not adversely impacted by jostling, shaking, or playful manhandling, etc.

Another aspect of the present invention includes an underwater device that can shoot a vortex ring to a distance of about 5-25 feet in the water.

Another aspect of the present invention includes an underwater device for generating or shooting a vortex ring, wherein the vortex ring can be pointed and/or directed at a target at will. The device can, therefore, be used to engage in underwater games that are fun, playful, and/or competitive.

Another aspect of the present invention includes an underwater device for generating or shooting a vortex ring that can more preferably be used by scuba or skin divers, or other users/enthusiasts, to ward off hostile marine life, or simply for sports/recreation.

Another aspect of the present invention includes an underwater device for generating or shooting a vortex ring that is automatic or self-priming. In other words, the device need not be cocked or recocked. The device can, therefore, be used repeatedly without interruptions, or the need to take it out of water.

Another aspect of the present invention includes an underwater device for generating or shooting a vortex ring that includes a source of compressed/pressurized fluid or air, which source can be a regular size scuba tank, a pony tank, or a cartridge.

Another aspect of the present invention includes an underwater device for generating or shooting a vortex ring that is self-contained in that it includes a supply of compressed/pressurized fluid or air.

Another aspect of the present invention includes an underwater device for generating or shooting a vortex ring to a distance of about 40 feet or more in the water.

Another aspect of the present invention includes an underwater device for generating a vortex ring, including a liquid chamber, and a fluid chamber contiguous to the liquid chamber and separated by a partition wall. The liquid chamber includes a generally rigid section and a compressible section. The rigid section includes an opening for selectively loading the liquid chamber with a liquid and for discharging a vortex ring therefrom.

Another aspect of the present invention includes a hand-held underwater device for generating a liquid vortex ring, including a liquid chamber, and an air chamber contiguous to the liquid chamber and separated by a partition wall. The liquid chamber includes a generally rigid section and a compressible section. The rigid section includes an opening for selectively loading the liquid chamber with a liquid and for discharging a vortex ring therefrom. A conduit supplies air from the air chamber to an area adjacent the opening to be entrained in the vortex ring.

Another aspect of the present invention includes a self-contained underwater amusement device for shooting a liquid vortex ring, including a liquid chamber, and an air chamber contiguous to the liquid chamber and separated by a partition wall. The liquid chamber includes a liquid accelerator section and a compressible section. The accelerator section includes an opening for loading the liquid chamber with a liquid. A conduit supplies air from the air chamber to an area adjacent the opening to be entrained in the vortex ring. A plurality of actuators move the compressible section for creating an internal pressure to shoot the vortex ring from the opening.

Another aspect of the present invention includes an underwater device for generating a vortex ring, including a liquid chamber, and a fluid chamber contiguous to the liquid chamber and separated by a partition wall. A liquid propulsion member is positioned within the liquid chamber, and an opening selectively loads the liquid chamber with a liquid and discharges a vortex ring therefrom.

Another aspect of the present invention includes a self-priming underwater device for generating a vortex ring entrained with a fluid, including a handle, a housing including front and rear sections, a trigger for supplying a fluid to the housing, a piston assembly in the rear section of the housing and including a yoke, a piston movable in the yoke, and a plate for displacing a liquid, and a splitter for diverting one portion of the fluid to the piston assembly to thereby move the piston. The front section of the housing includes an opening for discharging a vortex ring therefrom, and a fluid supply member is positioned adjacent the opening for supplying another portion of the fluid to be entrained in the vortex ring.

Another aspect of the present invention includes a hand-held self-priming underwater device for shooting a vortex ring entrained with a fluid, including a handle, a housing extending substantially rectilinearly with the handle and including front and rear sections, a trigger for supplying a fluid to the housing, a piston assembly in the rear section of the housing and including a yoke, a piston movable in the yoke, and a plate for displacing a liquid, and a splitter for diverting one portion of the fluid to the piston assembly to thereby move the piston. The front section of the housing includes an opening for discharging a vortex ring therefrom, and a fluid supply member is positioned adjacent the opening for supplying another portion of the fluid to be entrained in the vortex ring. A wall is provided between the handle and the housing and includes a first surface facing the housing and a second surface facing the handle. The yoke is disposed on the first surface and includes a port through which the piston moves. A generally circular recess is defined by the yoke and the inside of the housing.

BRIEF DESCRIPTION OF THE DRAWINGS

One of the above and other aspects, novel features and advantages of the present invention will become apparent from the following detailed description of a preferred embodiment(s) of the invention, as illustrated in the drawings, in which.

DETAILED DESCRIPTION OF THE PREFERRED EMBODIMENT(S) OF THE INVENTION

Figure 1:
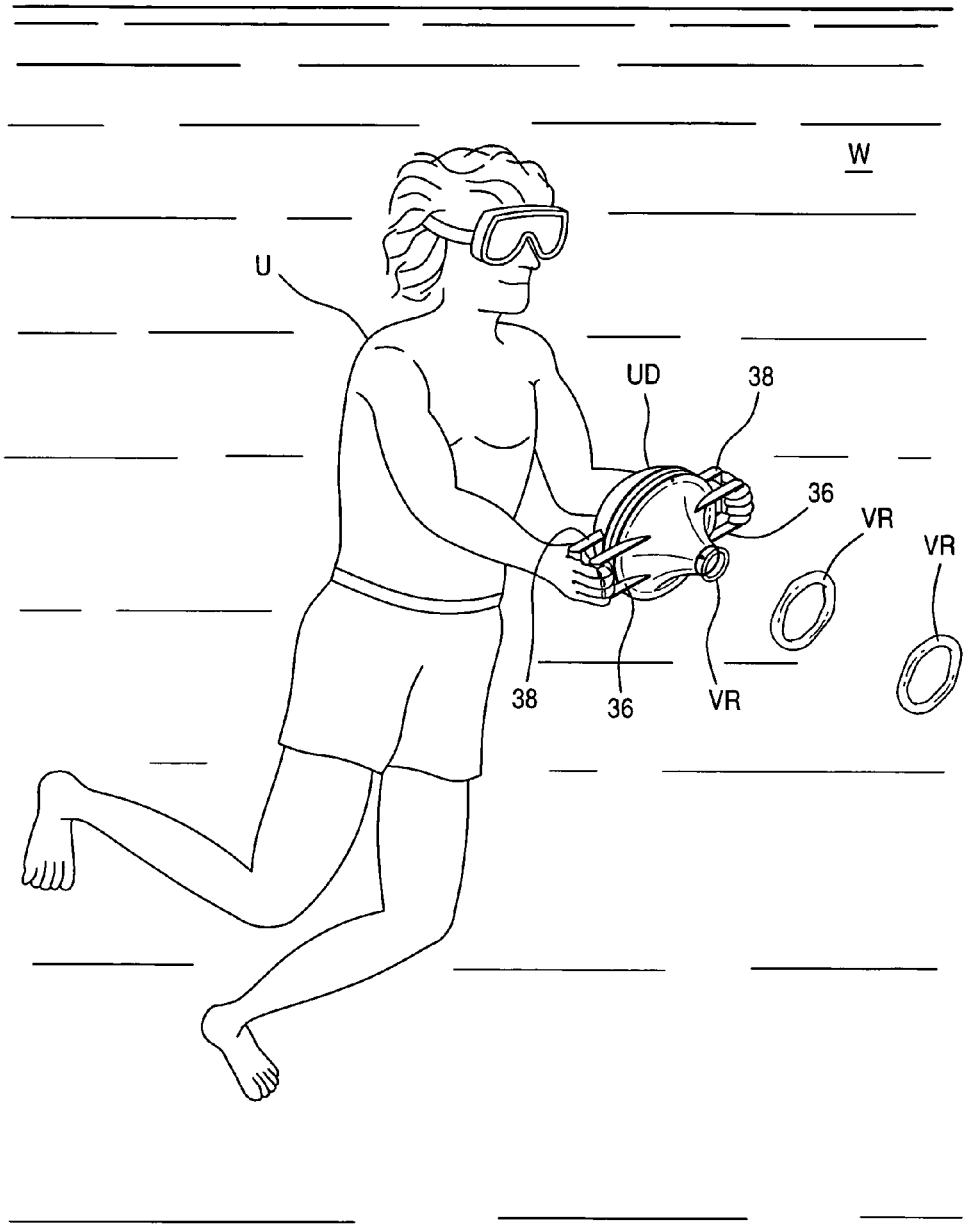
FIG. 1 illustrates a first preferred embodiment of the device of the present invention, shown in use.

As best shown in FIGS. 1-4, the underwater device UD, in accordance with a first embodiment of present invention, includes front and rear shells 10 and 12, respectively, connected by a middle compressible section 14. A partition wall 16 separates the rear shell 12, from the front shell 10 and the middle compressible section 14, which together form a liquid chamber 18 to hold a liquid, such as water W. The rear shell 12 includes a fluid chamber 20 for supplying, for example, low-pressure air to be entrained in the vortex rings VR, as described below in more detail.

Preferably, the front shell 10 is generally cone- or funnel-shaped, and the rear shell 12 is concave or dome-shaped. Both the front and rear shells 10 and 12 are, preferably, made of a clear or colored plastic, or the like rigid material. Alternatively, the front and rear shells 10 and 12 may be made of metal, or other solid or translucent material.

A fluid-supply assembly 22 includes a one-way check valve 24, mounted preferably centrally on the partition wall 16, an inlet tube 26, and an outlet tube 28. The fluid (or air) from the fluid chamber 20 passes through the check valve 24 and exits the outlet tube 28 at the opening 30 thereof, which is strategically positioned adjacent a front opening 32 of the underwater device UD. The front opening 32 is used to shoot vortex rings VR therefrom, as well as to initially fill (or load) the chamber 18 with the liquid.

Figure 3:
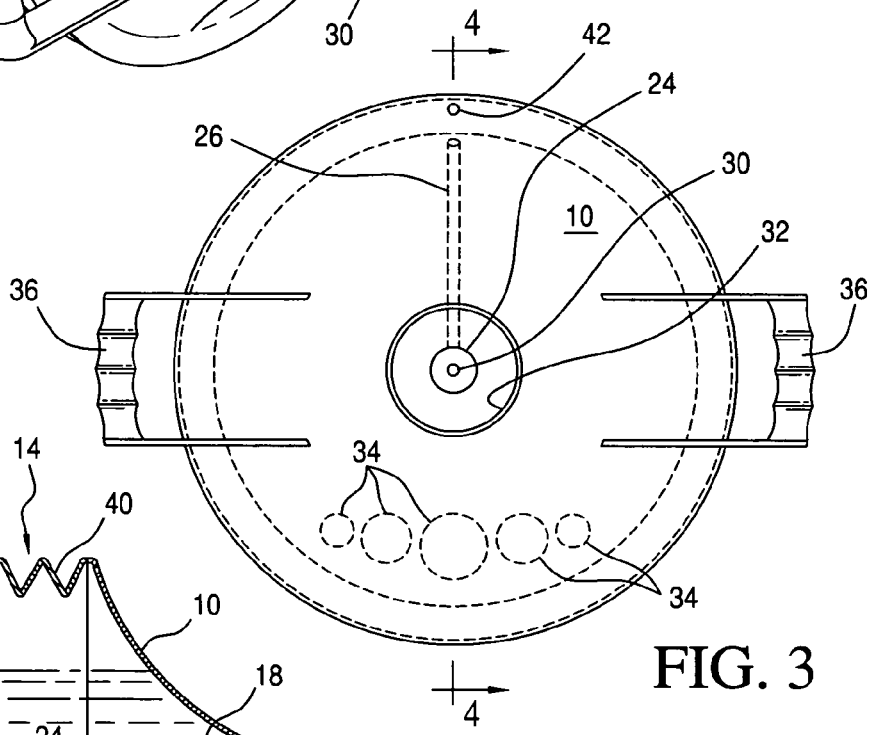
FIG. 3 is a front elevational view of the device shown in FIG. 2.
Figure 4:
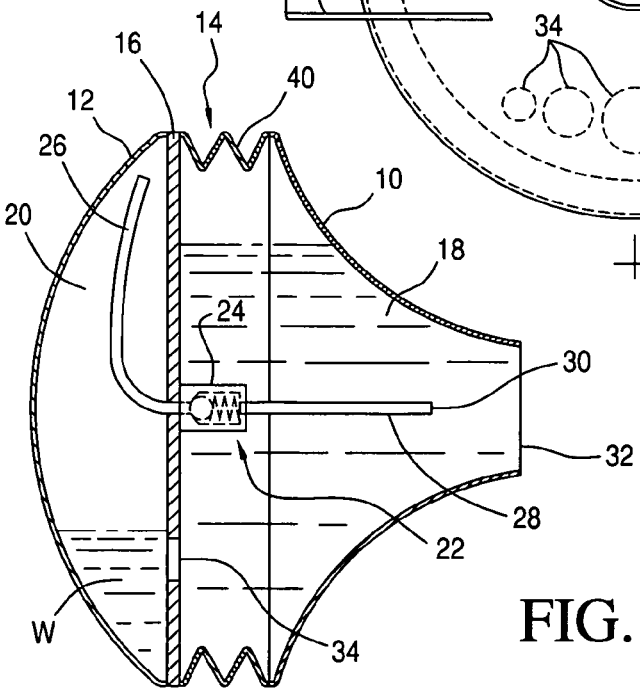
FIG. 4 is a vertical cross-sectional view taken along line 4-4 of FIG. 3.

As best shown in FIG. 3, preferably five holes 34 of varying diameters are provided in the partition wall 16, so as to allow the liquid chamber 18 to be in fluid communication with the fluid chamber 20. It is noted herewith that the number, diameter, shape, configuration, arrangement, etc., of the holes 34 may be varied, as desired, to alter the functionality and/or efficiency of the underwater device UD.

The underwater device UD further includes front and rear handles 36 and 38, preferably mounted on each of the left and right sides of the front and rear shells 10 and 12, respectively. The handles 36 and 38 can be integrally molded with the respective shells 10 and 12, or made separately. It will be appreciated that the front and rear handles 36 and 38 can be squeezed, jerked, or snapped together quickly by a user U (FIG. 1), to allow a swift relative movement between the front and rear shells 10 and 12, via the middle compressible section 14. In this regard, it is noted herewith that although the compressible section 14 is preferably configured as a bellows 40, other forms or construction may be used. For example, the compressible section 14 can be a flexible or pliable membrane, a resilient diaphragm, or the like structure.

The preferred shape of the front shell 10 enhances or maximizes the force of liquid, such as water, to be discharged through the front opening 32 of the underwater device UD, as a toroid, even when a small force is utilized to squeeze the front and rear handles 36 and 38. In other words, the front shell 10 functions as an accelerator for the water, when the underwater device UD is actuated or fired.

Figure 2:
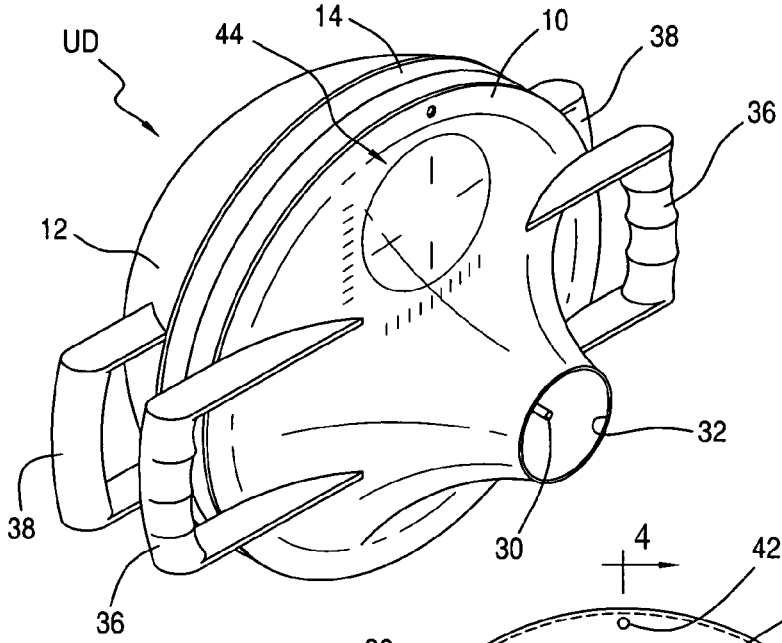
FIG. 2 is a perspective view of the first preferred embodiment of the device of the present invention.

As best shown in FIGS. 2-3, a vent hole 42 is provided near the top of the front shell 10 to allow the air to escape from the liquid chamber 18. In order to enhance the aiming aspect or appeal of the underwater device UD, a suitable graphic 44, preferably simulating a scope reticle, is provided on the front on the shell 10. The graphic 44 may be imprinted, stenciled, or applied on a sticker or the like clear label.

Although variable, it is preferred that the liquid and fluid chambers 18 and 20, occupy about three-fourth and one-fourth of the overall volume of the underwater device UD, respectively.

Figure 5:
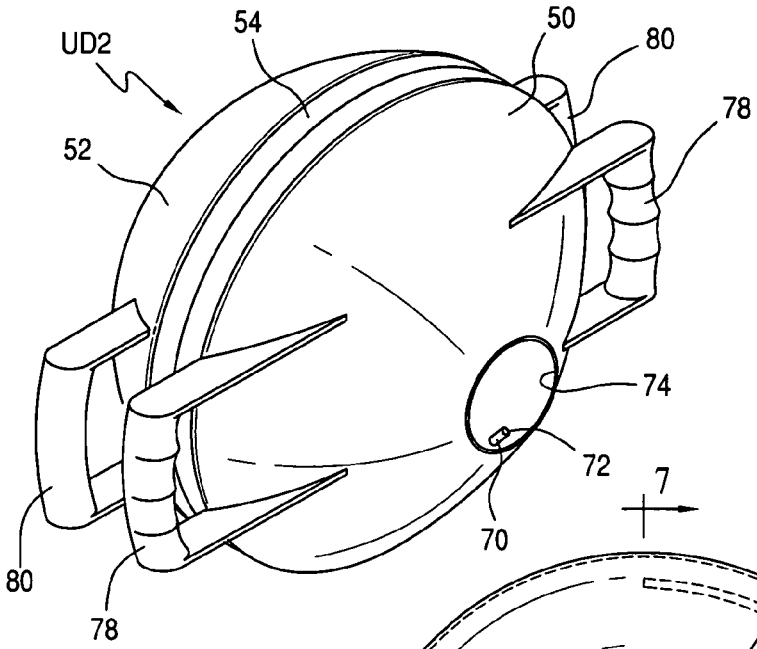
FIG. 5 is a perspective view of a second preferred embodiment of the device of the present invention.
Figure 6:
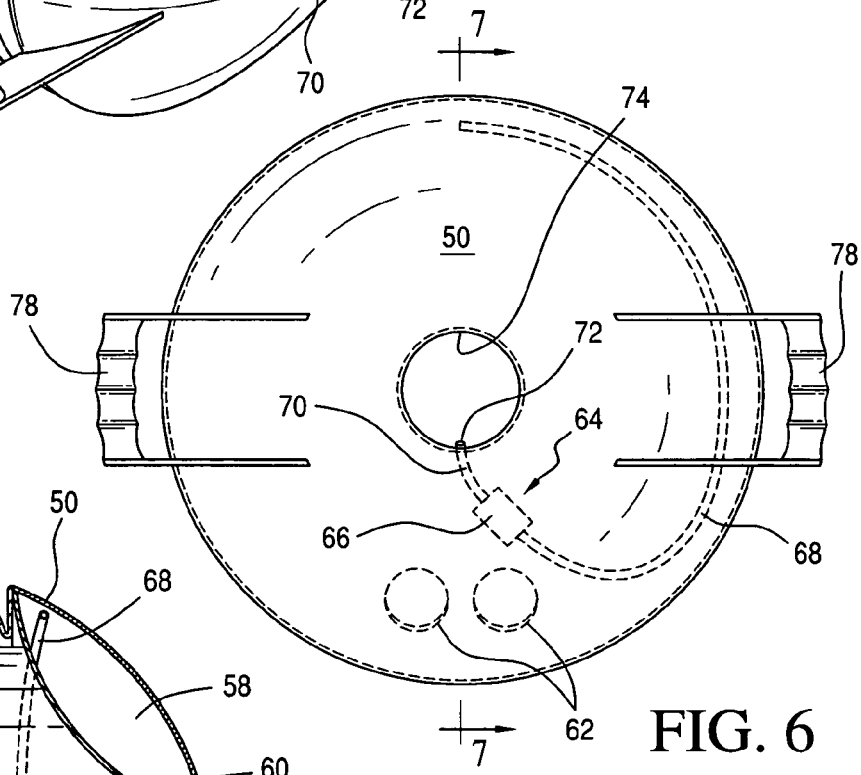
FIG. 6 is a front elevational view of the device shown in FIG. 5.
Figure 7:
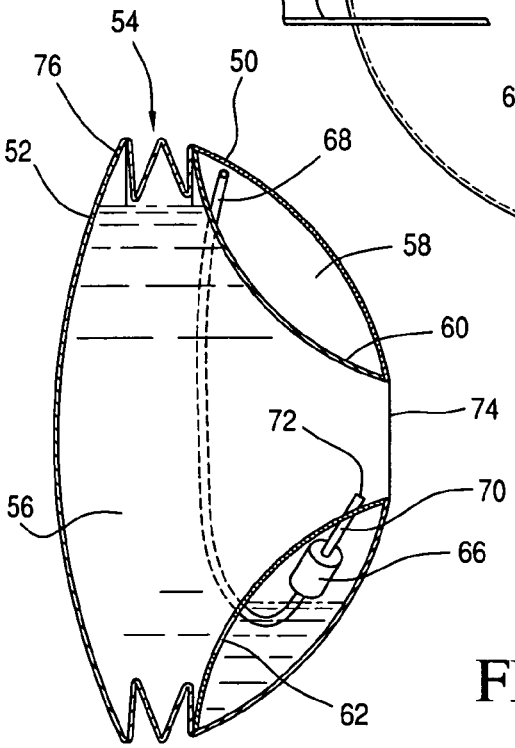
FIG. 7 is a vertical cross-sectional view taken along line 7-7 of FIG. 6.

Referring to FIGS. 5-7, a second preferred embodiment of the underwater device UD2 will now be described. As shown, the underwater device UD2 includes generally concave or dome-shaped front and rear shells 50 and 52, respectively, connected by a middle compressible section 54. The compressible section 54 is similar in design and construction to the middle compressible section 14, described above in connection with the first preferred embodiment. Likewise, the front and rear shells 50 and 52 are made of clear, translucent, or solid plastic or the like rigid material, which may be colored.

The rear shell 52 and the middle compressible section 54, together form a liquid chamber 56 for holding, for example, water W. As best shown in FIG. 7, the front shell 50 includes a generally circular or ring-shaped recess 58, which functions as a fluid or air chamber and is separated from the liquid chamber 56 by a partition wall 60. Preferably, two holes 62 in the partition wall 60 keep the chambers 56 and 58 in a fluid communication. It is noted herewith that it is within the scope of the present invention to vary the size, shape, and/or the number and arrangement of the holes 62, as desired, to vary the functionality and/or efficiency of the underwater device UD2.

A fluid-supply assembly 64 includes a one-way check valve 66, an inlet tube 68, and an outlet tube 70. The outlet tube opening 72 is positioned adjacent the front opening 74 of the underwater device UD2, to supply a fluid, such as air, to be entrained in the vortex ring or slug of water exiting therethrough. The inlet tube 68 runs along the outer periphery of the front shell 50 and terminates in the fluid chamber 58. Although not shown, clips or other suitable mechanical fasteners, or adhesive, may be used to secure the fluid-supply assembly 64 in place.

As in the first preferred embodiment UD, a hole 76 is provided but in the rear shell 52 to allow the air to vent from the liquid chamber 56. Likewise, left and right sets of front and rear handles 78 and 80, are provided on each side of the front and rear shells 50 and 52, respectively, to allow the user U to move or squeeze the shells 50 and 52, to operate or fire the underwater device UD2.

Figure 8:
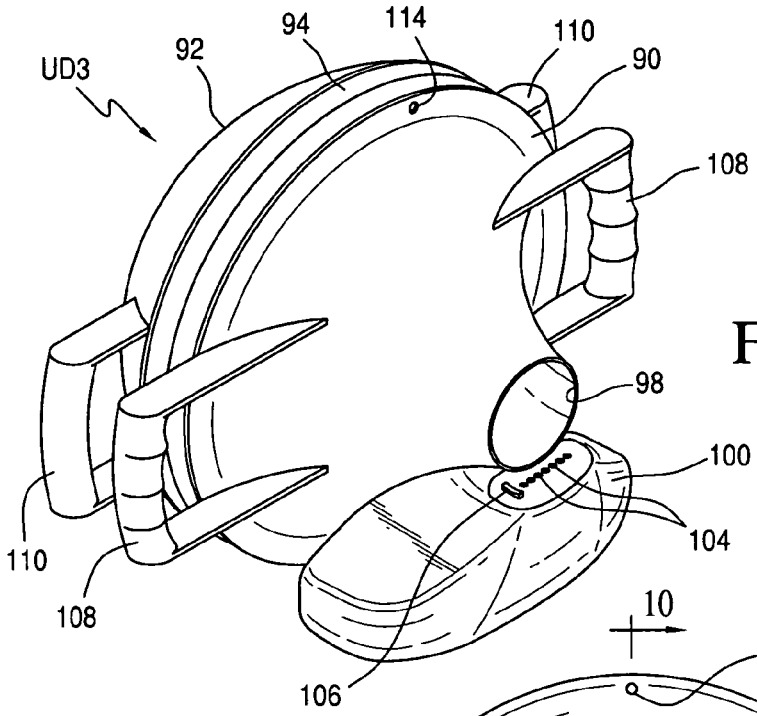
FIG. 8 is a perspective view of a third preferred embodiment of the device of the present invention.
Figure 9:
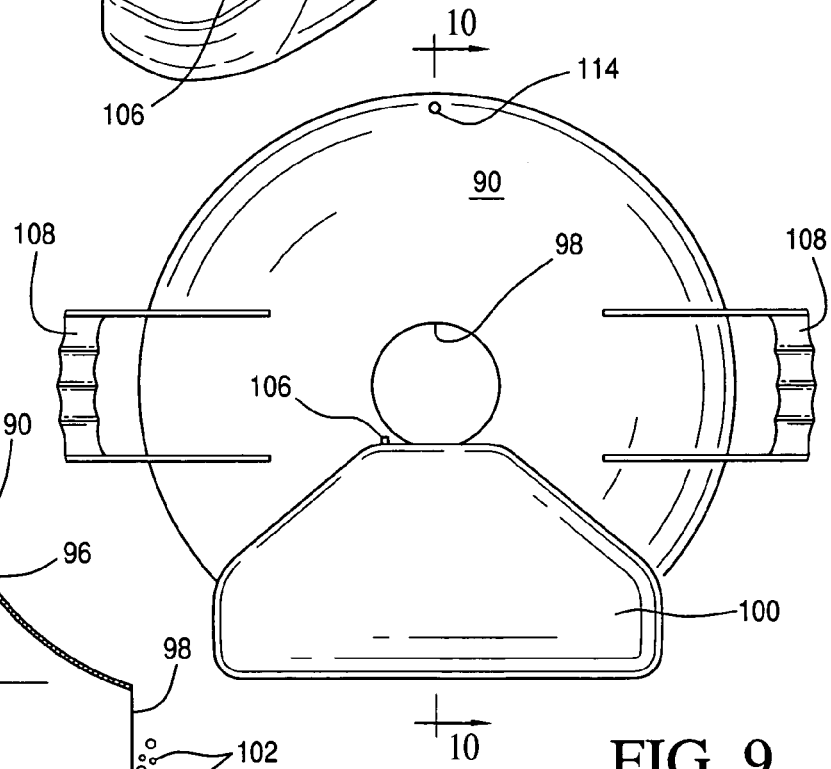
FIG. 9 is front elevational view of the device shown in FIG. 8.
Figure 10:
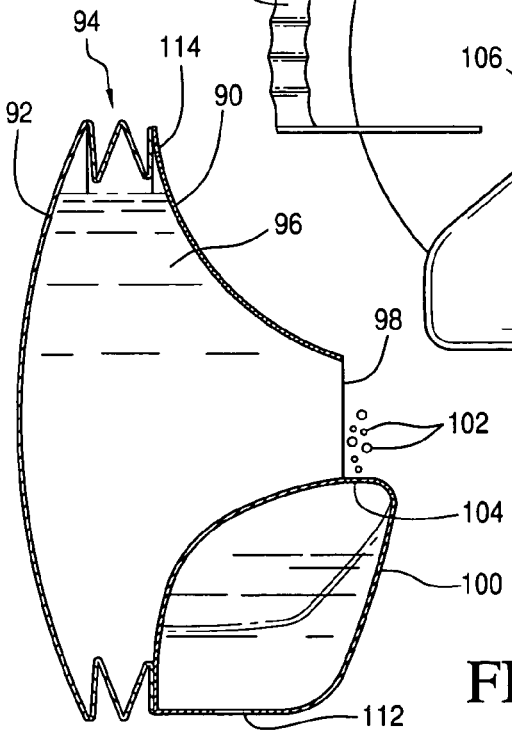
FIG. 10 is a vertical cross-sectional view taken along line 10-10 of FIG. 9.

Referring to FIGS. 8-10, a third preferred embodiment of the underwater device UD3 will now be described. As shown, the underwater device UD3 preferably includes a cone-shaped front shell 90 and a generally concave rear shell 92. The front and rear shells 90 and 92 are connected by a middle compressible section 94, which is similar in design and construction to the above-described compressible sections 14 and 54. Likewise, the front and rear shells 90 and 92 are made of clear, translucent, or solid plastic or the like rigid material, which may be colored.

The front and rear shells 90 and 92, and the middle compressible section 94, together define a liquid chamber 96 for holding a liquid, such as water W. The front shell 90 includes a front opening 98 which is used to fill the chamber 96 with the liquid, as well as to shoot vortex rings VR therefrom.

The third embodiment of the underwater device (UD3) is different from the embodiments described above in that an external housing 100 serves as a fluid chamber for supplying a fluid, such as air, in the form of bubbles 102 in front of the front opening 98, via a series of tiny holes 104. A suitable slider 106 is provided to selectively cover one or more of the holes 104, to vary the amount or location of the exiting series of the bubbles 102. As in the previous embodiments, left and right sets of front and rear handles 108 and 110, are mounted on the front and rear shells 90 and 92, respectively. The underwater device UD3 is particularly suitable for users who are unable to, or do not desire to, squeeze the handles 108 and 110 too hard to shoot vortex rings VR through the front opening 98.

As best shown in FIG. 10, a bottom opening 112 allows for draining of any liquid that gets collected inside the housing 100, during use. As in the previous embodiments, a hole 114 in the front shell 90 allows the air to vent from the liquid chamber 96.

Figure 14:
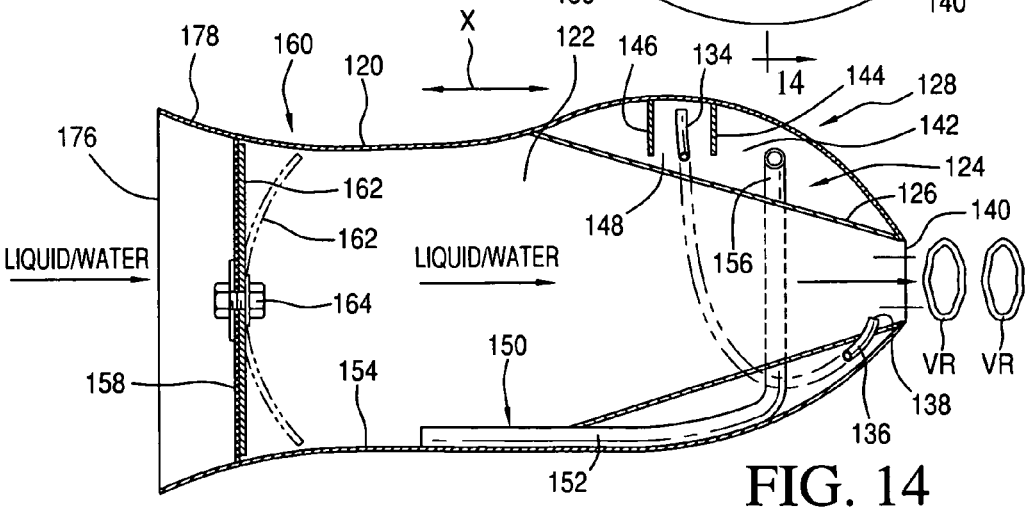
FIG. 14 is a vertical cross-sectional view taken along line 14-14 of FIG. 13.
Figure 15:
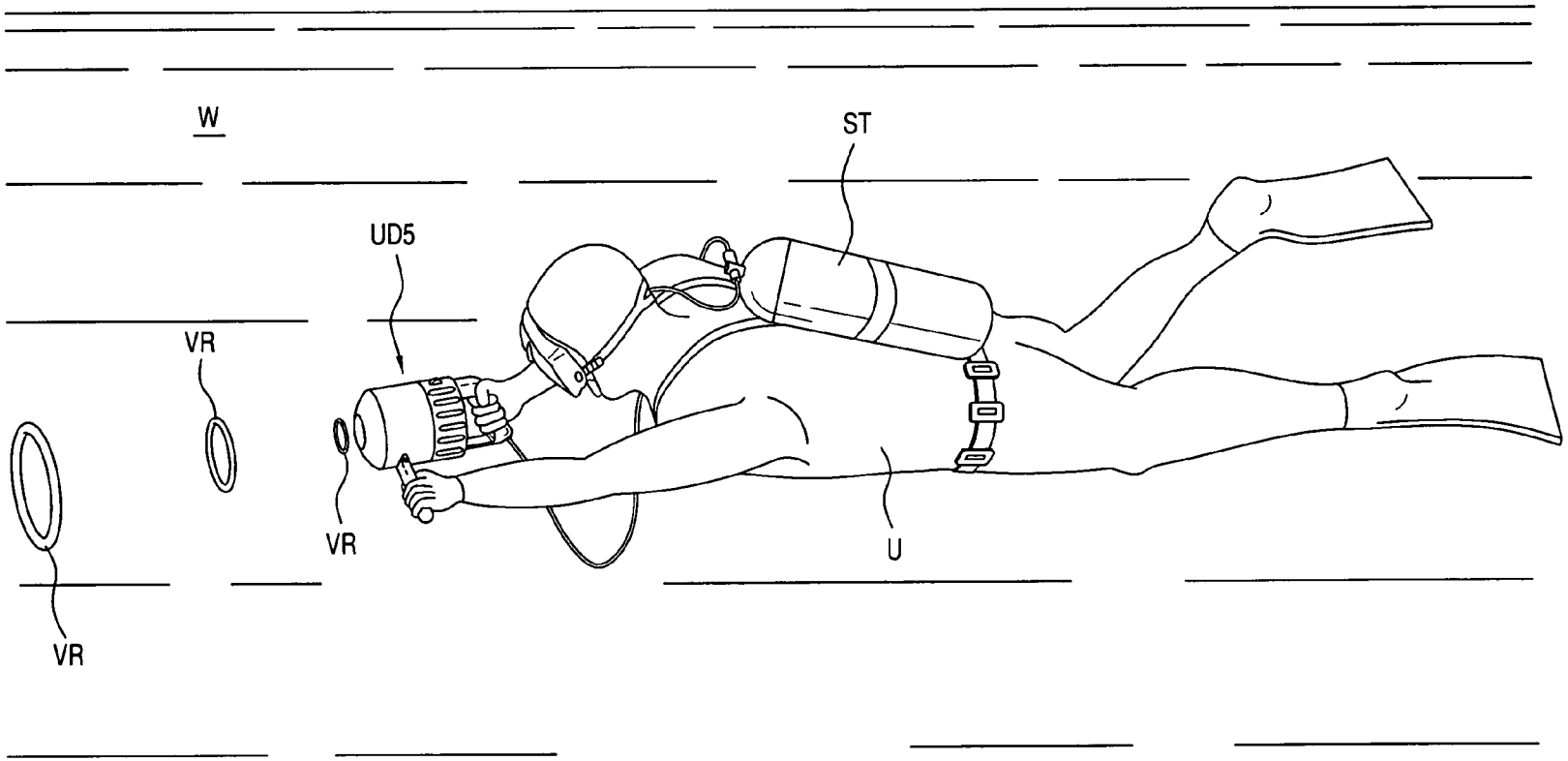
FIG. 15 illustrates a fifth preferred embodiment of the device of the present invention, shown in use by a scuba or skin diver.

Referring to FIGS. 11-14, a fourth preferred embodiment of the underwater device UD4 will now be described. As shown, the underwater device UD4 preferably includes a hollow housing 120 of a generally rigid material. The housing 120 is preferably elongated and follows the general configuration of a fish in cross-section to render aerodynamic properties (FIG. 14). It is noted herewith that it is within the scope of the present invention to utilize other shapes or configurations, as desired.

The interior of the housing 120 includes a liquid chamber 122 and a fluid chamber 124, separated by a partition wall 126, which is preferably cone-shaped. As best shown in FIG. 14, the fluid chamber 124 is preferably circular in configuration and is positioned in the front, hump section 128 of the housing 120.

A fluid-supply assembly 130 is positioned in the hump section 128 and includes a one-way check valve 132, an inlet tube 134, and an outlet tube 136. The outlet tube opening 138 is positioned adjacent the front opening 140 of the underwater device UD4. The inlet tube 134 terminates in an upper section 142 of the fluid chamber 124, where the front and rear baffles 144 and 146 provide an air-dam zone 148 for the inlet tube 134. The air-dam zone 148 prevents the liquid from entering the inlet tube 134.

As best shown in FIG. 14, an L-shaped compression hose 150 propels a portion of the liquid from the liquid chamber 122 into the fluid chamber 124. The compression hose 150 includes a lower section 152 extending along the bottom 154 of the housing 120, and an upper section 156, which extends along the interior periphery of the hump section 128 and terminates in the fluid chamber 124. The liquid carried by the hose 150, creates a compression force or pressure in the fluid chamber 124 to push the fluid into the inlet tube 134.

Figure 12:
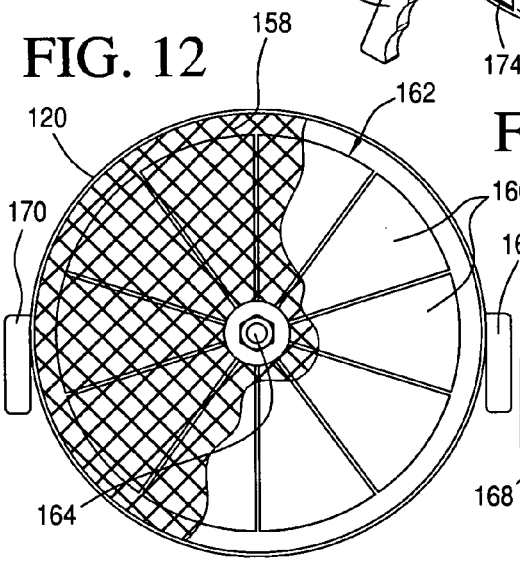
FIG. 12 is a rear elevational view of the device shown in FIG. 11.
Figure 13:
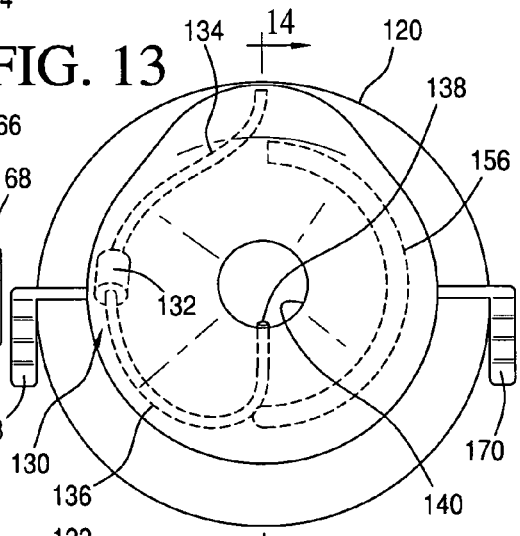
FIG. 13 is a front elevational view of the device shown in FIG. 11.

As best shown in FIGS. 12 and 14, a preferably rigid mesh or grill 158 is positioned in the rear section 160 of the housing 120. A diaphragm 162 is fastened on the inside of the mesh 158 by suitable mechanical fasteners 164. The diaphragm 162 is preferably made of a flexible or bendable material and is slit radially to provide multiple blades 166, in a fan-like configuration.

Figure 11:
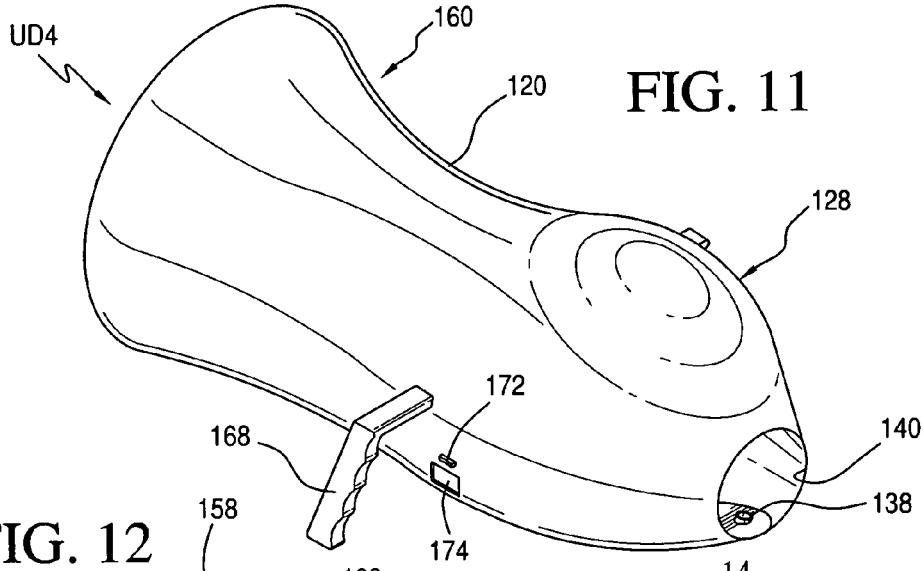
FIG. 11 is a fourth preferred embodiment of the device of the present invention.

Left and right handles 168 and 170 are provided to allow a user to grasp the underwater device UD4 for use. As best shown in FIG. 11, a slider switch 172 is positioned adjacent the left handle 168 to allow a user to open a door 174 for draining the water from inside the fluid chamber 124.

In underwater device UD4, the liquid or water enters the housing 120 through the rear opening 176 and exits via the front opening 140 in the form of vortex rings VR, when a user jerks or shakes the device UD4 back and forth in an underwater environment (arrow X in FIG. 14).

As best shown in FIG. 14, a generally flared tail section 178 directs more water into the housing 120, via the rear opening 176, the flow of which accelerates by the Venturi effect created by the funnel or conical shape of the partition wall 126.

In the various embodiments of the underwater device illustrated herein, the ratio of the diameter of the front opening (32, 74, and 98) to the overall diameter of the device, is 0.6-1.6 to 4, preferably 0.8-1.2 to 4, and more preferably 1 to 4. In this regard, it is noted herewith that although the embodiments are illustrated with a single, circular front opening, it is within the scope of the invention to vary the shape and number thereof for enhancing the performance, efficiency, and/or functionality of the device. For instance, it may be desirable to shoot more than one vortex rings simultaneously, and of different sizes. Therefore, an embodiment of the underwater device can be devised, where more than one front opening, of different shapes and/or sizes shapes, is provided. It is also within the scope of the present invention to provide a suitable mechanism for generating a sound, or some sort of audio signal, when the front and rear handles are actuated or snapped together to fire the device. For example, an audible mechanism can be incorporated in the device of the present invention to generate a crunching or a high-pitch squeak, or the like sound when the device generates vortex rings. It is further within the scope of the invention to add a suitable mechanism that generates a visual indicator or illumination, which signals the firing of the device, and/or simply highlights the vortex rings or their paths of travel through the water.

In order to shoot multiple vortex rings VR, without reloading of the underwater device of the present invention, it is preferred that the volume of the liquid chamber be about three times of the fluid chamber. This construction would produce about five to fifty vortex rings with one full chamber of air. It is noted herewith that the volumes of the liquid and fluid chambers may be varied to increase or decrease the number of vortex rings to be shot without the need for reloading of the device with water and fluid.

Figure 20:
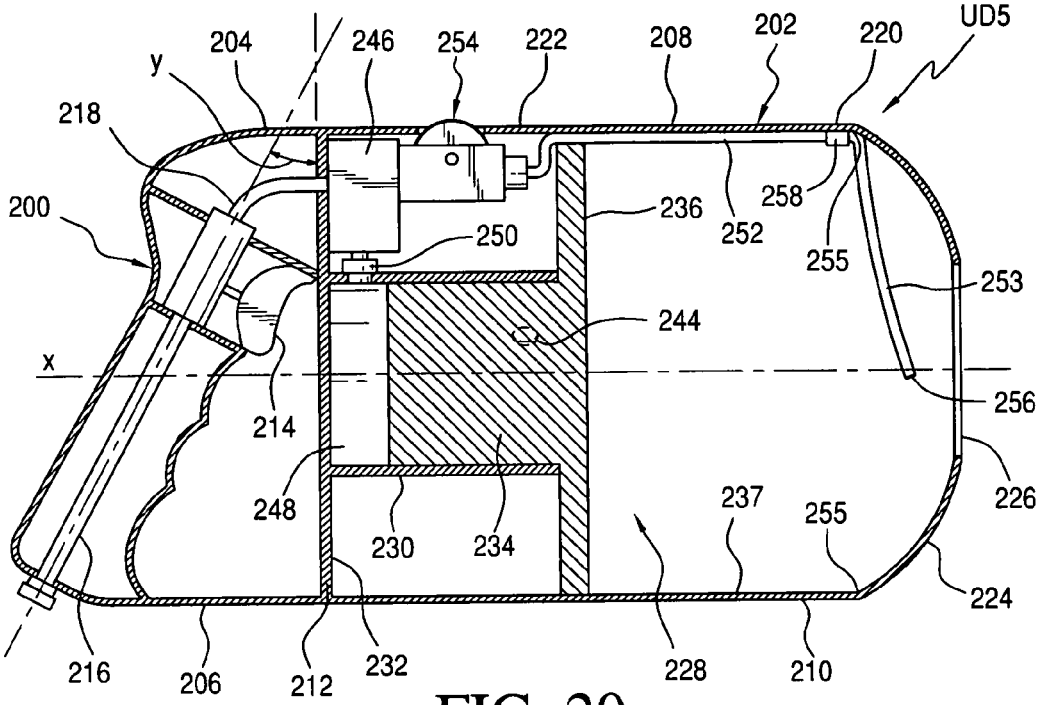
FIG. 20 is a vertical cross-sectional view taken along line 20-20 of FIG. 18.

Referring to FIGS. 15-26, a fifth preferred embodiment of the underwater device UD5 will now be described. As best shown in FIGS. 17 and 20-22, the underwater device UD5 includes a handle 200 and a housing 202. Preferably, the handle 200 is positioned directly behind the housing 202 such that both extend rectilinearly along a common horizontal plane in a manner that the vertical center of both components lies on a common axis shown by 'X' in FIG. 20. To that end, it is preferable that the top and bottom surfaces 204 and 206, respectively, of the handle 200 be generally co-linear with the top and bottom surfaces 208 and 210, respectively, of the housing 202 (FIG. 20). This construction imparts the underwater device UD5 with an overall hydrodynamic/aerodynamic shape.

As best shown in FIG. 20, the handle 200 and the housing 202 are separated by a partition wall 212. For the ease and comfort of a user U in holding and maneuvering the underwater device UD5, and to minimize the effects of recoil forces when the device is fired, handle 200 is angled rearwardly relative to the wall 212. Preferably, the angle 'Y' ranges between about 30°-60°.

Figure 16:
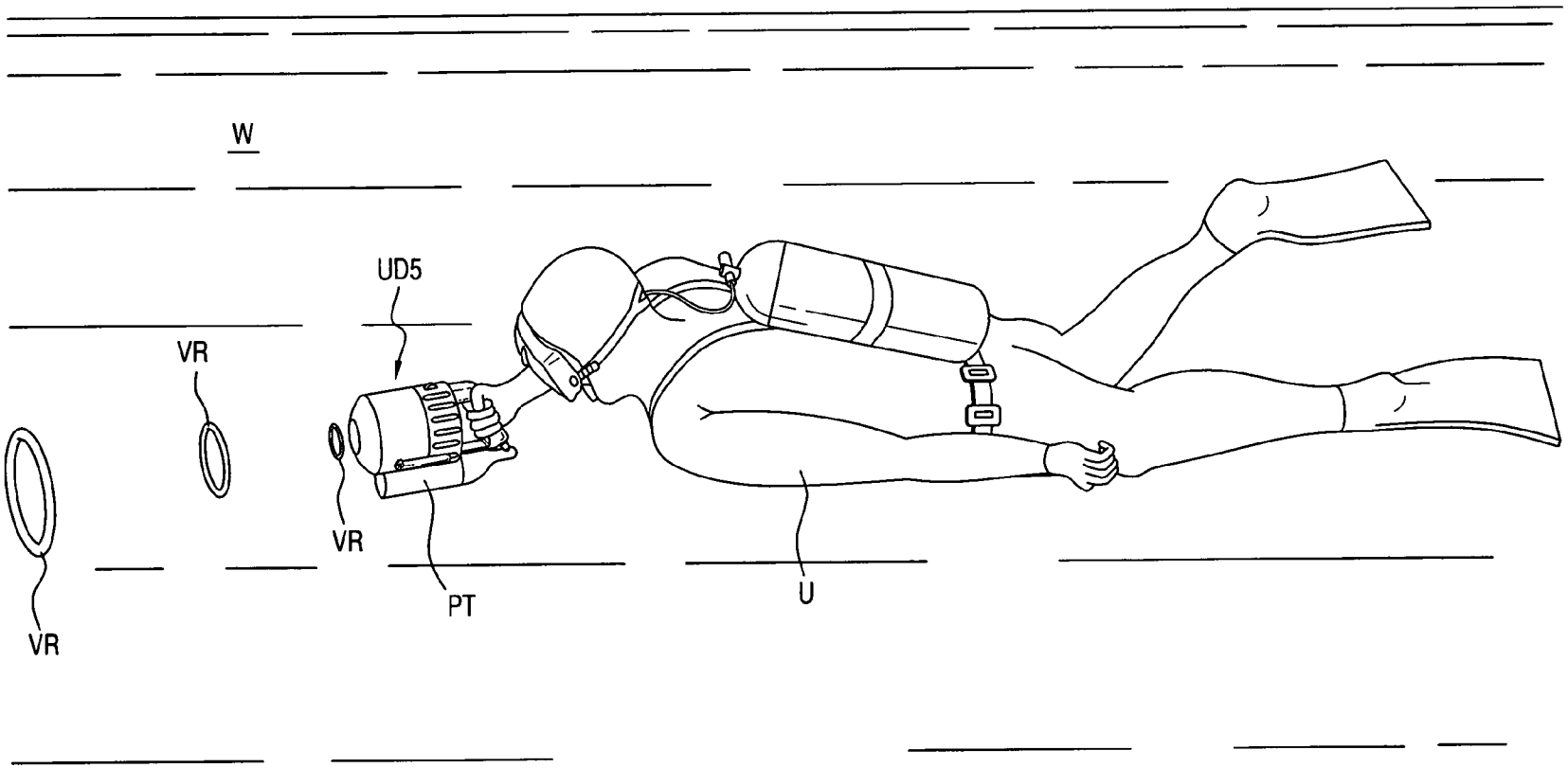
FIG. 16 is similar to FIG. 15, showing the device with a pony tank.

The handle 200 includes a conventional trigger assembly 214 disposed between an inlet line 216 and an outlet line 218. The inlet line 216 supplies a compressed or pressurized fluid or air coming from a source, which can be a regular scuba tank ST typically used by scuba divers (FIG. 15), or a pony tank PT typically used by skin divers (FIG. 16). Alternatively, a miniature cartridge of a compressed fluid or air or the like device may be used (not shown), and which would preferably be accommodated inside the handle 200.

Although not shown, the trigger assembly 214 may be designed in a manner to allow more fluid or air to flow to the fluid outlet line 218, when pulled hard, and to allow smaller amounts of the fluid or air to flow when a softer pull is exerted.

Preferably, the housing 202 is in the shape of a stubby barrel, including a front portion 220 and a rear portion 222. The front portion 220 includes a somewhat shallow, cup-shaped nose 224 with an opening 226 for discharging vortex rings VR therefrom. A piston assembly 228 is provided in a cylinder or yoke 230. The yoke 230 is itself preferably centrally mounted on the front surface 232 of the wall 212.

The piston assembly 228 includes a piston 234 slidably positioned inside the yoke 230, and a larger front plate 236. The diameter of the front plate 236 is provided such that it has a tight clearance with the interior surface 237 of the housing 202, forming a fluid-tight seal therebetween, while sliding back and forth during use of the underwater device UD5. The yoke 230 and the interior surface 237 of the housing 200, define a circular recess 238, where various other components best shown in FIGS. 20-22 and described below, are accommodated.

Figure 18:
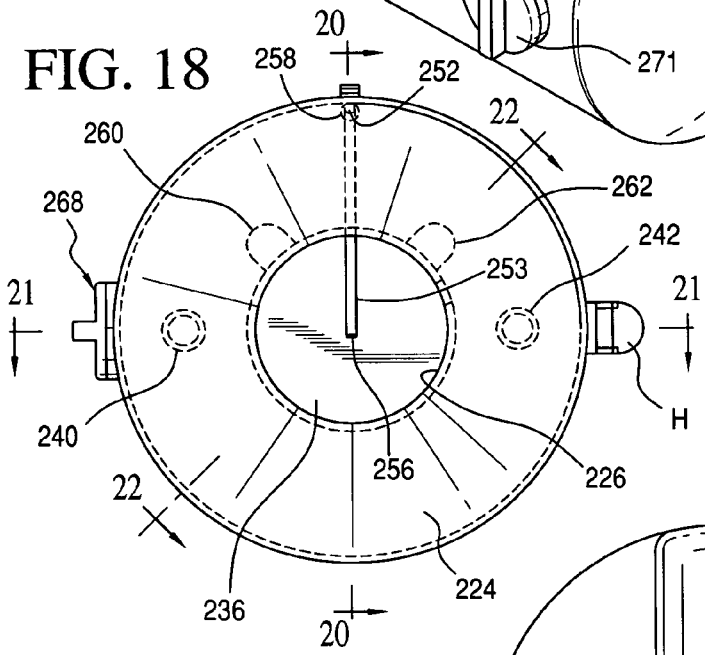
FIG. 18 is a front elevational view of the device shown in FIG. 17, with the side handle in a folded position.
Figure 19:
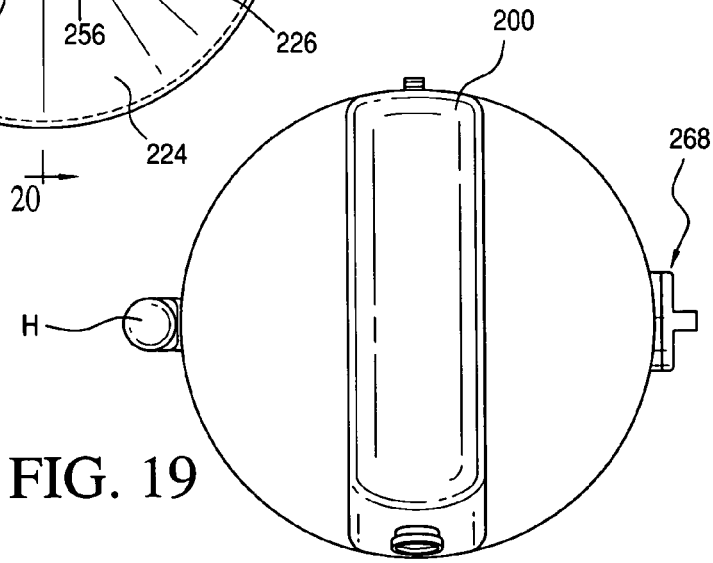
FIG. 19 is a rear elevational of the device shown in FIG. 18.
Figure 21:
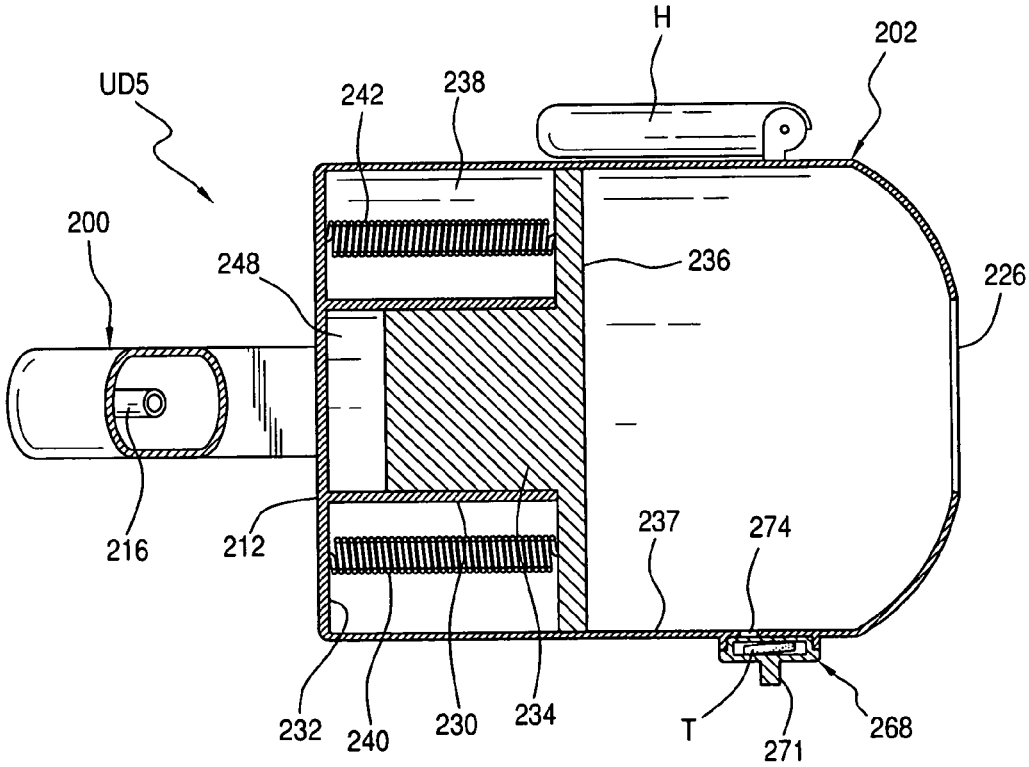
FIG. 21 is a vertical cross-sectional view taken along line 21-21 of FIG. 18.

As best shown in FIGS. 18 and 21, left and right springs 240 and 242, respectively, are provided in the recess 238 and are biased between the front plate 236 and the front surface 232 of the wall 212. Preferably, the springs 240 and 242 are disposed generally diametrically opposite to each other at nine o'clock and three o'clock positions. It is noted herewith that the number, the location and type of springs may be varied as desired, and further it is within the scope of the invention to use alternative components that function to keep the front plate 236 in position and to retract it after the underwater device UD5 is fired.

As best shown in FIG. 20, the yoke 230 includes a purge hole 244 to allow the air or fluid to exit when the underwater device UD5 is fired. In this regard, one of ordinary skill in the art would appreciate that the location of the purge hole 244 is selected such that it is blocked by the piston 234 before firing of the underwater device UD5 (FIG. 20), and unblocked when the piston 234 has moved forward upon firing of the device.

Referring to FIG. 20, the fluid outlet line 218 is in fluid communication with a conventional splitter 246 which diverts a preselected portion of the fluid or air to a chamber 248 lying between the yoke 230 and the wall 212, via an optional check valve 250. The splitter 246 diverts another preselected portion of the fluid or air to a line 252, via an optional adjuster knob assembly 254. The knob assembly 254 may be provided to adjust the amount of air or fluid being supplied to be entrained in a vortex ring VR. The line 252 runs along the interior surface 237 of the housing 200 and bends downwardly at a junction point 255 (where the nose 224 joins the front portion 220 of the housing 202) to form a nozzle 253 that terminates in an injection hole or opening 256. The nozzle 253 drops down toward the center of front opening 226 and, preferably, bends or flexes somewhat during a firing of the underwater device UD5. It is noted that the junction point 255 is also generally coincident with the end of the stroke of the piston 234. The position of the injection hole 256, lying generally centrally of the front opening 226 and adjacent the end of the piston stroke, allows optimum injection of the fluid or air into a slug of spinning water to form a cleaner, sharper, and/or smoother vortex ring VR. An optional check valve 258 may be provided to prevent any unintended back flow of air or fluid into the line 252.

Figure 17:
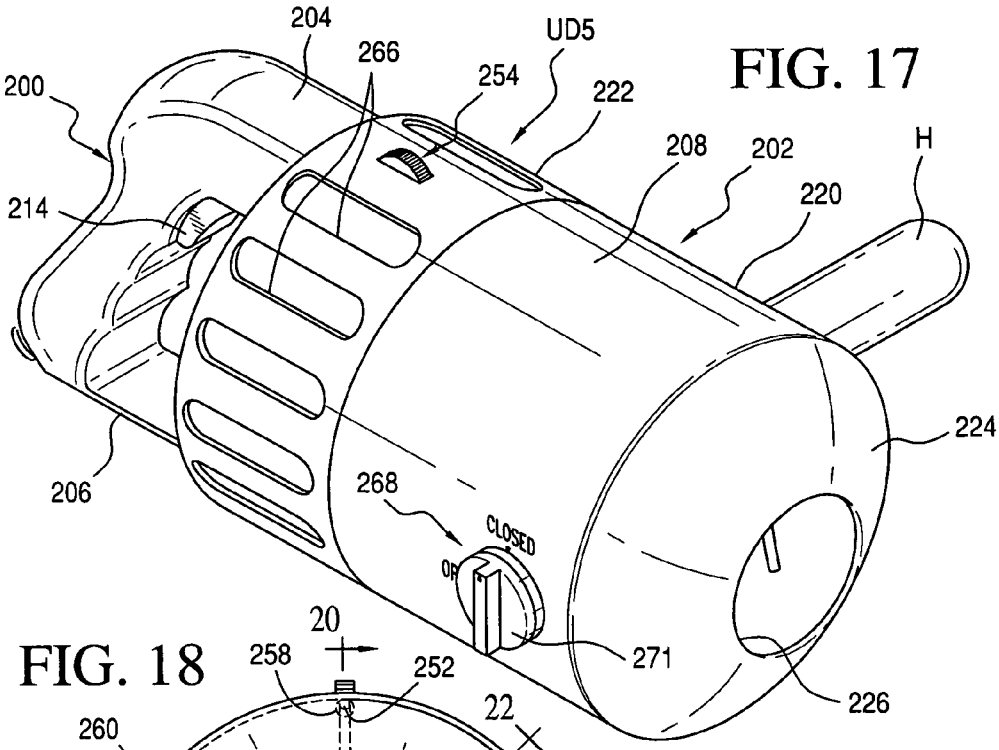
FIG. 17 is a perspective view of the device shown in FIG. 15.
Figure 22:
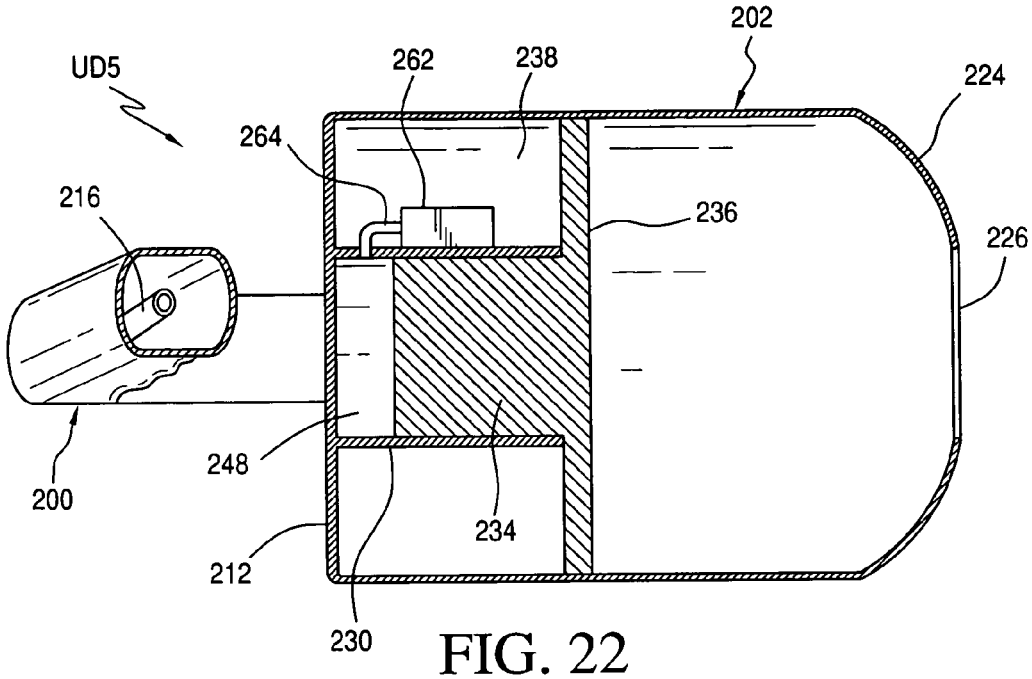
FIG. 22 is a vertical cross-sectional view taken along line 22-22 of FIG. 18.
Figure 23:
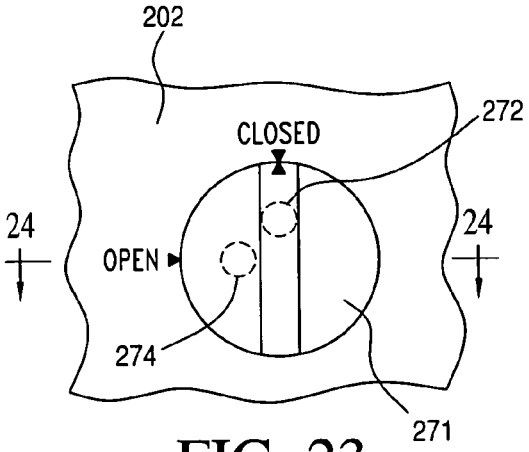
FIG. 23 is an enlarged schematic view showing the die assembly in a closed position.
Figure 25:
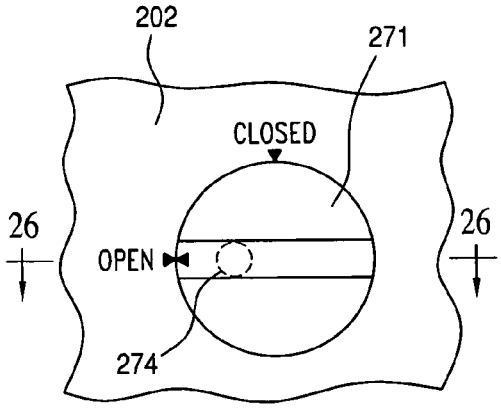
FIG. 25 is a view similar to FIG. 23, showing the die assembly in an open position.
Figure 24:
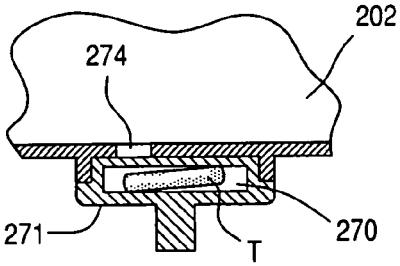
FIG. 24 is a cross-sectional view taken along line 24-24 of FIG. 23.
Figure 26:
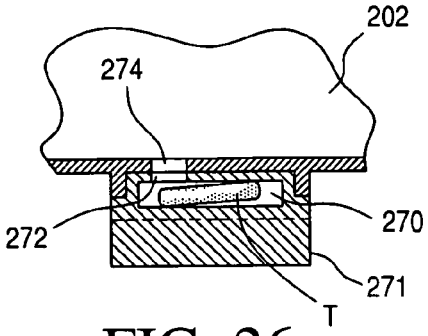
FIG. 26 is a cross-sectional view taken along line 26-26 of FIG. 25.

As best shown in FIGS. 18 and 22, two excess flow check valves 260 and 262 are provided in the recess 238, preferably at eleven o'clock and one o'clock positions. The valves 260 and 262 are in fluid communication with the chamber 248, via an associated line 264 and function to discharge excess fluid or air. In particular, when the trigger 214 is actuated and the high pressure fluid or air enters the chamber 248, the valves 260 and 262 will close momentarily, thereby trapping the high pressure fluid or air inside the chamber 248 and force the piston 234 to slam forward quickly. Once the high pressure event is finished, the valves 260 and 262 will open, thereby allowing the air or fluid remaining inside the chamber, but now at a low pressure, to drain or exhaust out from the chamber 248 and exit through the oblong-shaped vents 266, which are circumferentially arranged in the rear portion 222 of the housing 200 (FIG. 17). It is noted herewith that the total number and locations of the valves 260 and 262, and the number, shapes and locations of the vents 266 may be varied, as desired.

In order to optionally entrain the vortex rings VR with a pigment or color or the like, an optional dye assembly 268 is provided in the front portion 222 of the housing 200. As best shown in FIGS. 17 and 23-26, the dye assembly 268 preferably includes a chamber 270, which can selectively communicate with the interior of the housing 202 via a port 272 and a corresponding hole 274 in the housing 200. As can be seen from FIGS. 23-24, when the rotating dial 271 is in a closed position, the port 272 is out of alignment with the hole 274 in the housing 202. Thus, there is no fluid communication between the chamber 270 and the interior of the housing 202. On the other hand, when the dial 271 is rotated counterclockwise by 90°, the port 272 and the hole 274 are in alignment, thereby rendering the chamber 270 in fluid communication with the interior of the housing 202. Accordingly, in the open position shown in FIGS. 25-26, the liquid or water in the housing 202 will mix with the dye tablet T disposed in the chamber 270. As a result, the vortex ring VR exiting the underwater device UD5 will be entrained with the material of the tablet T.

In order to assist the user in properly, securely, and comfortably holding the underwater device UD5, especially when firing, a foldable side handle H is provided on one side of the housing 202.

Although not shown, suitable stops or abutment members may be provided on the inside of the front portion 220 of the housing 202 at the junction point 255, to limit the frontal movement of the plate 236, or to prevent over-shooting thereof.

Use and Operation

Referring to FIGS. 1-4, a preferred manner of using the underwater device UD of the present invention will now be described. A user U simply holds the underwater device UD, by grasping the left and right sets of front and rear handles 36 and 38, and submerges it in the water W. (One would appreciate that the fluid chamber of the device would be full of air before the device is brought under the water.) Once submerged, the user U simply holds the device UD until the liquid chamber gets filled up the water W entering through the front opening 32. At this point, the device UD is primed or fully loaded. In order to shoot a vortex ring VR, the user U simply jerks or snaps the front and rear handles 36 and 38 together. This swift action propels a toroid or slug of spinning water out of the front opening 32. Substantially simultaneously with this action, a portion of the water W is displaced into the rear, low pressure fluid chamber 20, through the holes 34 in the partition wall 16. This displacement of water causes a brief high pressure to build up in the rear fluid chamber 20, because of the swift motion between the front and rear shells 10 and 12. The increased pressure in the fluid chamber 20 forces the air therein to enter the inlet tube 26 and pass through the check valve 24, by overcoming the pressure therein, and shoots a small burst of air through the front opening 30, via the outlet tube 28. This tiny burst of air gets entrained in the vortex ring VR being formed substantially simultaneously therewith. Therefore, as the slug of water shoots out from the front opening 32, the burst of air from the outlet tube opening 30, forms a bubble ring in the low-pressure region of the vortex or toroid of spinning water.

The vortex rings VR formed by the underwater device UD of the present invention, are estimated to travel 12-16 feet through the water and bounce off the water surface when the underwater device UD is pointed towards the top. As also noted above, the unique design and construction of the underwater device UD allows for generating or shooting five to fifty vortex rings with one full chamber of air. In other words, once the underwater device UD is fully primed and loaded, multiple consecutive vortex rings can be shot one after another without having the need to bring the device out of the water to reload with air.

The second preferred embodiment of the underwater device UD2 operates in the same manner. The third embodiment of the underwater device UD3 also operates in a similar fashion, except that since the air in the external housing 100 automatically escapes in the form of bubbles through the tiny holes 104, the force with which the front and rear handles are needed to be snapped or to be squeezed, is relatively low, compared to the force needed in the first and second embodiments UD and UD2. As a result, this embodiment (UD3) is believed to be particularly suited for very young children, or those users who are unable to squeeze the front and rear handles hard.

As to the use and operation of the fourth preferred embodiment, the underwater device UD4 is primed or loaded in the same manner as the other embodiments discussed above. Once loaded with air and water, the device UD4 is simply jerked or thrust back and forth to force the water out through the front opening 140, as spinning slugs or toroids. During this movement, a portion of the water is displaced into the fluid chamber 124, via the compression hose 150 building a pressure therein, which forces a burst of air through the outlet tube opening 138, from the inlet tube 134 to the check valve 132 and through the outlet tube 136. This burst of air gets entrained in the water slugs being formed substantially simultaneously adjacent the front opening 140. In order to shoot or fire consecutive vortex rings, the user U merely need to keep thrusting the device UD4 back and forth, as shown by arrow X in FIG. 14.

With respect to the use and operation of the fifth preferred embodiment, the underwater device UD5 is primed or loaded by submerging in water. By simply holding it under water, the front portion 220 of the housing 202 will get filled up with the water W entering through the front opening 226. At this point, the device UD5 is primed or fully loaded. In order to shoot a vortex ring VR, the user U simply actuates the trigger 214, which allows a portion of the compressed or pressurized fluid or air to be injected into the chamber 248, causing the piston 234 and plate 236 to thrust forwardly. This action will result in swift, high pressure displacement of the water W, present in the front portion 220 of the housing 202, in the form of a toroid or slug of spinning water out of the front opening 226. Substantially simultaneously, a tiny burst of fluid or air is supplied to the toroid of spinning water by the opening 256 of the line 252. This fluid or air will be entrained in the low-pressure region of the vortex or toroid forming a bubble ring. As discussed above, the pressure in the chamber 248 will drop (no more supply of fluid or air from the outlet line 218) to a level lower than the retraction pressure of the springs 240 and 242. As a consequence, the piston 234 and plate 236 will retract to their initial position, creating a void in the front portion 220 of the housing 202, which void will instantly be filled with the surrounding water through the front opening 226, thereby automatically priming the underwater device UD5 for the next firing. In this manner, the underwater device UD5 can be fired repeatedly without cocking or recocking, or taking it out of the water.

The vortex rings VR produced by the underwater device UD5 are estimated to travel 40 feet or more through the water.

While this invention has been described as having preferred sequences, ranges, steps, materials, structures, shapes, configurations, features, components, or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and of the limits of the appended claims.

What is claimed is:

1. An underwater device for generating a vortex ring entrained with a fluid, comprising:

a) a handle;

b) a housing including front and rear sections;

c) a trigger for supplying a fluid to said housing;

d) a piston assembly in said rear section of said housing and including a yoke, a piston movable in said yoke, and a plate for displacing a liquid;

e) a splitter for diverting one portion of the fluid to said piston assembly to thereby move said piston;

f) said front section of said housing including an opening for discharging a vortex ring therefrom; and g) a fluid supply member positioned adjacent said opening for supplying another portion of the fluid to be entrained in the vortex ring.

2. The device of claim 1, wherein:

a) said handle and said housing are separated by a wall having front and rear surfaces; and b) said yoke is located on said front surface facing said opening.

3. The device of claim 2, wherein:

a) said yoke is located generally centrally on said front surface and defines a general circular recess with the inside of said housing.

4. The device of claim 3, wherein:

a) said splitter is disposed in said recess.

5. The device of claim 3, further comprising:

a) at least one retraction member in said recess for withdrawing said piston after the device is actuated to generate a vortex ring.

6. The device of claim 5, wherein:

a) said retraction member comprises a spring biased between said plate and said front surface of said wall.

7. The device of claim 6, wherein:

a) a plurality of said springs are biased between said plate and said front surface of said wall and are generally diametrically opposed to each other.

8. The device of claim 1, further comprising:

a) a chamber between said piston and said yoke for receiving said one portion of the fluid from said splitter; and b) an excess flow valve in communication with said chamber and the exterior of the device.

9. The device of claim 8, wherein:

a) a plurality of said excess flow valves are in communication with said chamber and the exterior of the device.

10. The device of claim 9, wherein:

a) two of said excess flow valves are circumferentially spaced around said yoke.

11. The device of claim 10, further comprising:

a) said two excess flow valves are circumferentially spaced by about 60°-120°.

12. The device of claim 1, further comprising:

a) a fluid adjustment member operably connected to said splitter for varying the amount of fluid to said fluid supply member.

13. The device of claim 1, further comprising:

a) means for supplying a material to be entrained in the vortex ring.

14. The device of claim 1, further comprising:

a) a supply assembly for including a material to be entrained in the vortex ring.

15. The device of claim 14, wherein:

a) the material comprises a dye.

16. A hand-held underwater device for shooting a vortex ring entrained with a fluid, comprising:

a) a handle;

b) a housing extending substantially rectilinearly with said handle and including front and rear sections;

c) a trigger for supplying a fluid to said housing;

d) a piston assembly in said rear section of said housing and including a yoke, a piston movable in said yoke, and a plate for displacing a liquid;

e) a splitter for diverting one portion of the fluid to said piston assembly to thereby move said piston;

f) said front section of said housing including an opening for discharging a vortex ring therefrom;

g) a fluid supply member positioned adjacent said opening for supplying another portion of the fluid to be entrained in the vortex ring;

h) a wall between said handle and said housing and including a first surface facing said housing and a second surface facing said handle;

i) said yoke being disposed on said first surface and including a port through which said piston moves; and j) a generally circular recess defined by said yoke and the inside of said housing.

17. The device of claim 16, further comprising:

a) at least one retraction member extending between said first surface and said plate for withdrawing said piston after the device is actuated to shoot a vortex ring.

18. The device of claim 17, wherein:

a) said retraction member comprises a spring biased between said first surface and said plate.

19. The device of claim 17, wherein:

a) said yoke comprises a hole for purging the fluid from the interior thereof.

20. The device of claim 17, wherein:

a) said splitter is disposed in said recess and is in fluid communication with a fluid source and said piston assembly.

21. The device of claim 1, further comprising:

a) a scuba tank for supplying the fluid.

22. The device of claim 1, wherein:

a) said fluid supply member comprises a nozzle including an injection hole; and b) said injection hole is located generally centrally of said opening.

* * * * *